US006581377B2

(12) United States Patent
Carlson et al.

(10) Patent No.: US 6,581,377 B2
(45) Date of Patent: Jun. 24, 2003

(54) CARBURIZATION OF VEHICLE MANIFOLD FLANGES TO PREVENT CORROSION

(75) Inventors: Patrick M. Carlson, Pinckney, MI (US); Dell G. Smith, Howell, MI (US); Roger A. Braun, Fenton, MI (US); Thomas P. Ketelhut, Jr., Grosse Ile, MI (US)

(73) Assignee: Metaldyne Tubular Products, Inc., Canton, MI (US)

( * ) Notice: Subject to any disclaimer, the term of this patent is extended or adjusted under 35 U.S.C. 154(b) by 0 days.

(21) Appl. No.: 10/024,929

(22) Filed: Dec. 19, 2001

(65) Prior Publication Data

US 2003/0014968 A1 Jan. 23, 2003

Related U.S. Application Data

(60) Provisional application No. 60/307,007, filed on Jul. 20, 2001.

(51) Int. Cl.[7] ..... F01N 7/10
(52) U.S. Cl. ..... 60/323; 60/313; 29/890.08
(58) Field of Search ..... 60/323, 313; 29/890.08

(56) References Cited

U.S. PATENT DOCUMENTS 4,372,112 A * 2/1983 Ackerman et al. ..... 60/282
4,373,331 A * 2/1983 Santiago et al. ..... 60/282
4,500,030 A * 2/1985 Gerber et al. ..... 228/125
4,689,952 A * 9/1987 Arthur et al. ..... 29/428
4,959,956 A * 10/1990 Yasuda ..... 29/890.08
5,419,127 A * 5/1995 Moore, III ..... 60/322
5,682,741 A * 11/1997 Augustin et al. ..... 285/125.1
5,687,787 A * 11/1997 Atmur et al. ..... 264/629
5,692,373 A * 12/1997 Atmur et al. ..... 60/274
5,706,655 A * 1/1998 Kojima et al. ..... 60/322
5,784,882 A * 7/1998 Bonny et al. ..... 60/323
5,911,683 A * 6/1999 Cui et al. ..... 60/302
6,038,769 A * 3/2000 Bonny et al. ..... 29/890.054
6,155,045 A * 12/2000 Durr et al. ..... 277/598
6,425,243 B1 * 7/2002 Chen et al. ..... 60/313

* cited by examiner

*Primary Examiner*—Thomas Denion
*Assistant Examiner*—Diem Tran
(74) *Attorney, Agent, or Firm*—McDonald Hopkins Company LPA

(57) ABSTRACT

An exhaust manifold for a vehicle engine and a manufacturing process to prevent corrosion of the manifold during shipping and storage. The manifold includes a manifold body having a plurality of arms corresponding to the exhaust ports of the engine and a collector chamber for directing the exhaust gasses to the vehicle exhaust system. Attached to the ports of the body are flanges to facilitate connection of the manifold to the engine. The flanges are manufactured of carbon steel and includes apertures to receive mounting flanges. To prevent corrosion of the flanges, the flanges are subject to a process of ferritic nitro carburization which inhibits the formation of iron-oxide.

15 Claims, 1 Drawing Sheet

CARBURIZATION OF VEHICLE MANIFOLD FLANGES TO PREVENT CORROSION

RELATED APPLICATIONS

This application claims priority from U.S. Provisional Application No. 60/307,007 filed on Jul. 20, 2001.

BACKGROUND OF THE INVENTION

I. Field of the Invention

This invention relates to a process for manufacturing manifolds for a vehicle engine and, in particular, to applying a ferritic nitro carburization process to the flanges of the manifold to prevent corrosion in humid environments.

II. Description of the Prior Art

Vehicle engines incorporate manifolds for directing particular gasses through predetermined passageways. An engine exhaust manifold includes tubular arms in communication with the exhaust ports of the engine and a collector chamber in communication with the arms and the exhaust of the vehicle. Exhaust gasses from the engine flow through the arms to the collector chamber and then directed through the exhaust system including the catalytic converter.

While the body of the manifold may be cast, stamped or even hydroformed into the desired configuration, flanges are attached to the ports of the manifold to facilitate mounting to the engine and exhaust system. The flanges include a machined face to sealingly connect to the engine and a plurality of apertures to receive stud fasteners. However, these carbon steel flanges which are typically welded to a stainless steel manifold body are prone to corrosion particularly when stored in humid environments. While a minimum amount of rust will not inhibit performance of the manifold, the appearance of the rust gives the appearance of a defect and is typically cleaned off before mounting to the engine.

SUMMARY OF THE PRESENT INVENTION

The present invention overcomes the disadvantages of the prior known exhaust manifolds by providing a process of carburization of the manifold flanges to prevent corrosion.

The vehicle manifold of the present invention includes a body configured to fit within the engine compartment while directing exhaust gasses from the exhaust ports of the engine to the exhaust system. The body will include a collector chamber and a plurality of tubular arms corresponding to the exhaust ports. The arms are designed to communicate with the exhaust ports and direct the exhaust gasses to the collector chamber which is then directed to the exhaust system. Welded to the ports of the arms and the collector chamber are flanges for connecting the manifold to the engine. In a preferred embodiment, the manifold body is fabricated from stainless steel and the flanges are carbon steel. Apertures in the flanges receive stud fasteners to secure the manifold to the engine.

Prior to the attachment to the manifold body, the flanges are treated with a corrosion resistant material. In a preferred embodiment, the flanges are subjected to a ferritic-nitro carburization process nitrogen-based penetrant to infuse into the surface of the flange. This penetrant bonds with the existing oxides in the carbon steel flange to prevent the oxides from boding with the iron to form iron-oxide. Although alternative rust inhibitors are available, the ferritic nitro carburization process does not inhibit welding of the flanges to the manifold body and does not wear off in humid environments.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

BRIEF DESCRIPTION OF A PREFERRED EMBODIMENT OF THE PRESENT INVENTION

Figure 1:
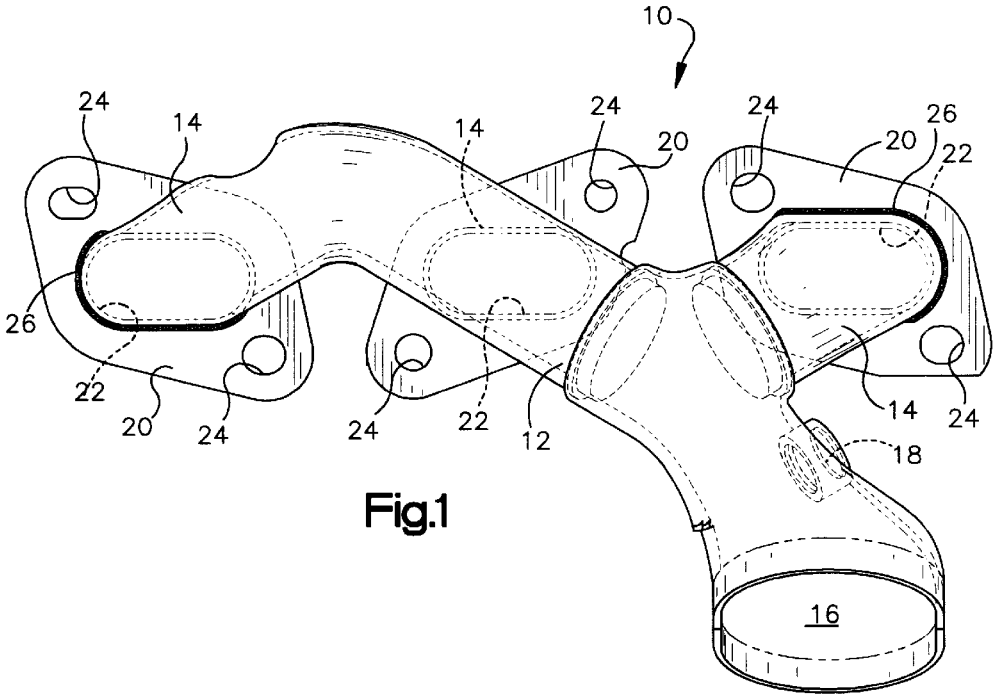
FIG. 1 is a first embodiment of an exhaust manifold subject to the carburization process of the present invention.
Figure 2:
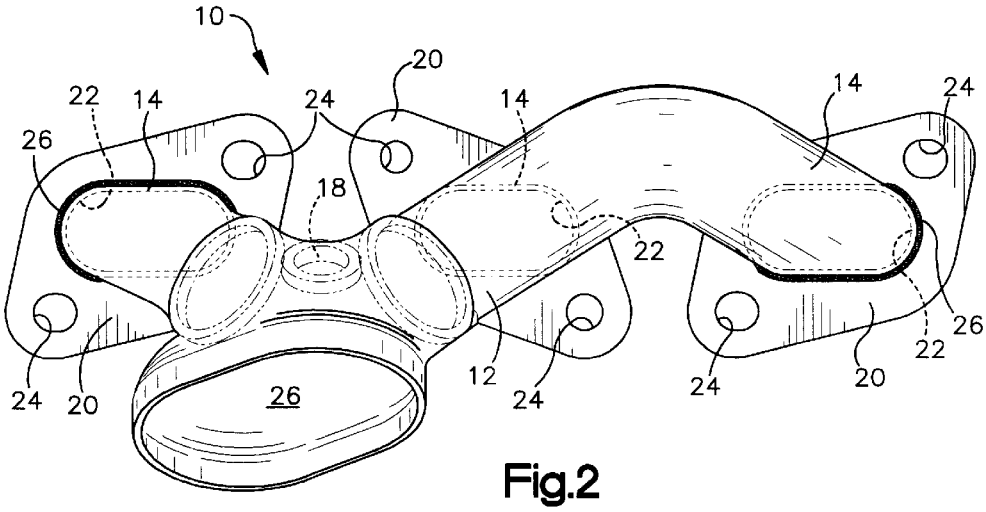
FIG. 2 is a second embodiment of an exhaust manifold subject to the carburization process of the present invention.

Referring to the drawing, there is shown various configurations of an exhaust manifold 10 designed to direct exhaust gasses from a vehicle engine to the vehicle exhaust system. Generally, the exhaust manifold 10 is fastened to the vehicle engine in direct communication with the exhaust ports of the engine. The exhaust system including the catalytic converter is attached to the manifold so that exhaust gasses are treated and expelled from the vehicle. Weight and space constraints within the engine compartment of the vehicle typically determine the configuration of the manifold although the present invention can be applied to manifolds of any configuration.

The vehicle manifold 10 of the present invention generally includes a body 12 having a plurality of arms 14 corresponding to the number of exhaust ports of the engine and a collector chamber 16 in communication with the arms 14. The manifold body 12 may be fabricated in any number of ways including casting, stamping or hydroforming. For purposes of this description, the manifold body 12 is stamped of a stainless steel material. The manifold body 12 may include seats and apertures 18 designed to receive sensors and similar measuring devices to ensure the efficient operation of the vehicle engine.

Attached to the ends of the arms 14 of the manifold 10 are substantially planar flanges 20 for mounting the manifold 10 to the vehicle engine. The flanges 20 are preferably made from carbon steel. The flanges 20 include a central port 22 to facilitate mating connection with the end of the arms 14 and apertures 24 for receiving fasteners to secure the manifold 10 to the engine. The flanges 20 have a flat face to ensure secure connections to the engine. In a preferred embodiment, the flanges 20 are welded to the ends of the arms 14 using a weld bead 26 applied at the external juncture of the arms 14 and the flange 20.

Because the flanges 20 are preferably formed of a carbon steel, they are subject to rust corrosion particularly when stored in humid environments or shipped overseas. Although not fatal to a secure, leak proof connection to the engine, excessive corrosion can deteriorate the face of the flange 20. Furthermore, rust on the flange 20 gives the appearance of a deteriorating product. In order to overcome this and inhibit corrosion of the flanges 20, the flanges 20 are subjected to a carburization process. Specifically, the flanges 20 are subjected to a ferritic nitro carburization process prior to assembly to the manifold body 12. During this process, the nitrogen penetrant that is infused into the surface of the carbon steel inlet flanges bonds with the existing oxides to prevent the oxides from mating with the iron to form iron oxide. Once assembled to the manifold body 12, the lower cost carbon steel flanges 20 perform similarly to the stainless steel manifold body 12 when subjected to humid conditions. In comparison testing, while untreated flanges completely rusted over in humidity testing, the ferritic nitro carburization flanges exhibit less than 5% rust after identical testing. The FNC process does not inhibit welding allowing the flanges 20 to be attached to the manifold body 12 after treatment. The treatment does not wear off or stick to packaging. Nevertheless, completed manifolds 10 are received at their destination free of signs of corrosion resulting in fewer returned components.

The foregoing detailed description has been given for clearness of understanding only and no unnecessary limitations should be understood therefrom as some modifications will be obvious to those skilled in the art without departing from the scope and spirit of the appended claims.

What is claimed is:

1. A manifold for a vehicle engine, said manifold comprising:

a manifold body having a plurality of arms and a collector chamber; and a plurality of flanges connected to said arms of said manifold body, said flanges including means for mounting said manifold to the vehicle engine;

said flanges having a carburization penetrant infused into the surface of the flange to prevent corrosion.

2. The manifold as defined in claim 1 wherein said carburization penetrant is applied through a ferritic nitro carburization process.

3. The manifold as defined in claim 2 wherein said flanges are made from carbon steel.

4. The manifold as defined in claim 3 wherein said manifold body is made from stainless steel.

5. A process for manufacturing a manifold for a vehicle engine comprising the steps of:

fabricating a manifold body having a plurality of arms and a collector chamber;

forming a plurality of mounting flanges corresponding to the number of arms of said manifold body;

subjecting said mounting flanges to a ferritic nitro carburization process; and attaching said mounting flanges to the ends of said arms of said manifold body.

6. The process as defined in claim 3 wherein said mounting flanges are welded to said arms of said mounting flanges.

7. The process as defined in claim 3 wherein said manifold body is stamped from a stainless steel material.

8. The process as defined in claim 5, wherein said flanges are made from carbon steel.

9. A manifold for a vehicle engine, said manifold comprising:

a manifold body having at least one arm extending therefrom;

a flange connected to said arm, said flange including means for mounting the manifold to the vehicle engine; and said flange having a carburization penetrant infused into the surface thereof to prevent corrosion.

10. The manifold as defined in claim 9 wherein said carburization penetrant is applied through a ferritic nitro carburization process.

11. The manifold as defined in claim 10 wherein said flange is made from carbon steel.

12. A process for manufacturing a manifold for a vehicle engine comprising the steps of:

fabricating a manifold body having at least one arm extending therefrom;

providing a mounting flange that has been subjected to a ferritic nitro carburization process; and attaching said mounting flange to the end of said arm.

13. The process as defined in claim 12 wherein said flange is made from carbon steel.

14. The process as defined in claim 13 wherein said attaching step comprises welding said mounting flange to the end of said arm.

15. The process as defined in claim 14 wherein said manifold body is made from stainless steel.

* * * * *